US007234884B1

(12) United States Patent
Tratar

(10) Patent No.: US 7,234,884 B1
(45) Date of Patent: Jun. 26, 2007

(54) RIBBON SPOOL LOCK ASSEMBLY

(75) Inventor: David B. Tratar, Dearborn, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 11/282,877

(22) Filed: Nov. 18, 2005

(51) Int. Cl.
*B41J 35/08* (2006.01)

(52) U.S. Cl. ..... 400/139; 400/234; 400/663; 400/664

(58) Field of Classification Search ..... 400/208, 400/219, 234, 691–693, 191, 242, 663–664, 400/139
See application file for complete search history.

(56) References Cited

U.S. PATENT DOCUMENTS 4,050,375 A * 9/1977 Orlens ..... 101/110
4,188,135 A * 2/1980 Mizutani et al. ..... 400/214
4,242,005 A * 12/1980 Kondur, Jr. ..... 400/220.1
4,337,001 A * 6/1982 Cappotto ..... 400/208
4,350,454 A * 9/1982 Schoenlein ..... 400/234
4,440,514 A * 4/1984 Keiter et al. ..... 400/208
4,605,325 A * 8/1986 Hofmann ..... 400/207
4,605,327 A * 8/1986 Ueki et al. ..... 400/208
4,990,008 A * 2/1991 Hwang ..... 400/208
5,086,697 A * 2/1992 Koper et al. ..... 101/336
5,769,548 A * 6/1998 Thompson et al. ..... 400/208
5,779,372 A * 7/1998 Jorgensen ..... 400/191
5,897,256 A * 4/1999 Kameyama ..... 400/208
6,997,628 B2 * 2/2006 Tu ..... 400/208

* cited by examiner

*Primary Examiner*—Manish S. Shah
*Assistant Examiner*—Mark John Stevenosky, Jr.
(74) *Attorney, Agent, or Firm*—Richard J. Gregson; Brooks Kushman, PC

(57) ABSTRACT

A printing mechanism requires ribbon spools to be locked in place radially, and includes a pivoting ribbon tension arm that must be pivoted out of its normal operating position when ribbon is to be replaced. A ribbon spool lock assembly includes a rotating locking hub on the side of the printing mechanism. The rotating locking hub includes a locking feature that protrudes into the printing mechanism to radially lock the ribbon spool when the locking hub is in a locked position. A pivoting lock arm is provided for pivoting the locking hub into an unlocked position in which the locking feature is disengaged from the ribbon spool.

16 Claims, 4 Drawing Sheets

RIBBON SPOOL LOCK ASSEMBLY

BACKGROUND OF THE INVENTION

1. Field of the Invention

The invention relates to offset-type printing mechanisms for high-speed printing of magnetic ink character recognition (MICR) symbols which use a conventional spool of print ribbon.

2. Background Art

Offset-type printing mechanisms typically require that depleted spools of ribbon media be replaced at regular integrals by less-skilled personnel. Because such printing mechanisms typically include spring tensioner, guide and locking elements to ensure correct installation, location and control of the ribbon and ribbon replacement mechanisms must be designed with an eye to swift, self-evident and foolproof ways of replacing ribbon for minimum downtime.

Existing approaches fail to address all of these concerns. Existing approaches typically require operators to learn and remember a specific routine of steps for ribbon replacement, deviation from which will lead to problems.

For the foregoing reasons, there is a need for an improved ribbon spool lock assembly for use in offset-type printing mechanisms.

SUMMARY OF THE INVENTION

It is an object of the invention to provide an improved ribbon spool lock assembly in which the operator can only replace the ribbon by a series of steps which are designed-into the mechanism and which cannot be deviated from.

The invention involves mechanisms designed in such a way that ribbons cannot be replaced incorrectly. The invention also involves mechanisms which temporarily displace other machine elements which would interfere with ribbon replacement.

In carrying out the invention, a ribbon spool lock assembly for use in a print mechanism is provided. The print mechanism is of the type in which ribbon spools are required to be locked in place radially when the mechanism is functioning. The invention uses a positive radial spool lock for this purpose. This lock must be opened by some operator interaction when ribbon is to be replaced.

The print mechanism also includes a pivoting ribbon tension arm, which applies tension to the ribbon for printing-related purposes. The tensioner arm must be pivoted out of its normal operating position when ribbon is to be replaced, and held out of position during the replacement process. Yet the tensioner arm must be returned to the normal operating position before normal printing recommences.

According to the invention, a rotating locking hub is built into the side of the printing mechanism. The locking hub includes a locking feature that protrudes into the printing mechanism in such a way as to radially lock the ribbon spool in the correct position for printing.

A preferred approach employs a pair of linked rotating hubs built into each side of the printing mechanism. The locking hubs include locking features that protrude into the printing mechanism in such a way as to radially lock the ribbon spools in the correct positions for printing. In this way, each end of each ribbon spool is radially locked.

Further, in the preferred approach, the locking hubs are pivoted into a released or unlocked position by way of two pivoting lock arms. These lock arms may be designed to be operated with the operator's fingers. When in the released position, the linked locking hubs are pivoted out of the exit/entry path of the ribbon spools. This allows the ribbon spools to be removed and replaced.

In another comprehended feature of the invention, the pivoting lock arms contain additional features which interlock with the pivoting ribbon tensioner arm to automatically pivot and lock the tensioner arm to its load ribbon position.

Accordingly, in operation of the preferred embodiment of the invention, an operator cannot remove ribbon spools until the locking hubs are rotated to the correct released positions by means of the two pivoting lock arms. This causes the tensioner arm to rotate to the correct load ribbon position. Once the operator threads the new ribbon through the printer mechanism and initially tensions the printer system manually or by some other automated ribbon advanced feature, the pivoting ribbon tensioner arm is caused to rotate forward and automatically release the two pivoting lock arms. At this point, springs cause the linked locking hubs to rotate back to the correct lock position for printing.

It is appreciated that the preferred embodiment contains features which lock both ribbon spools (supply and takeup) with a pair of linked locking hubs and two pivoting lock arms. Various changes may be made in the implementation of the invention according to the needs of a particular design of a printing mechanism. For example, locking hubs could be used to secure only one spool of ribbon. Further, for example, the entire system may be operated automatically rather than by manual operation, in which case the interlocking of various parts in their correct positions would be by sensors and electronic control rather than by physical, mechanical interlocks.

DETAILED DESCRIPTION OF THE PREFERRED EMBODIMENT

Figure 1:
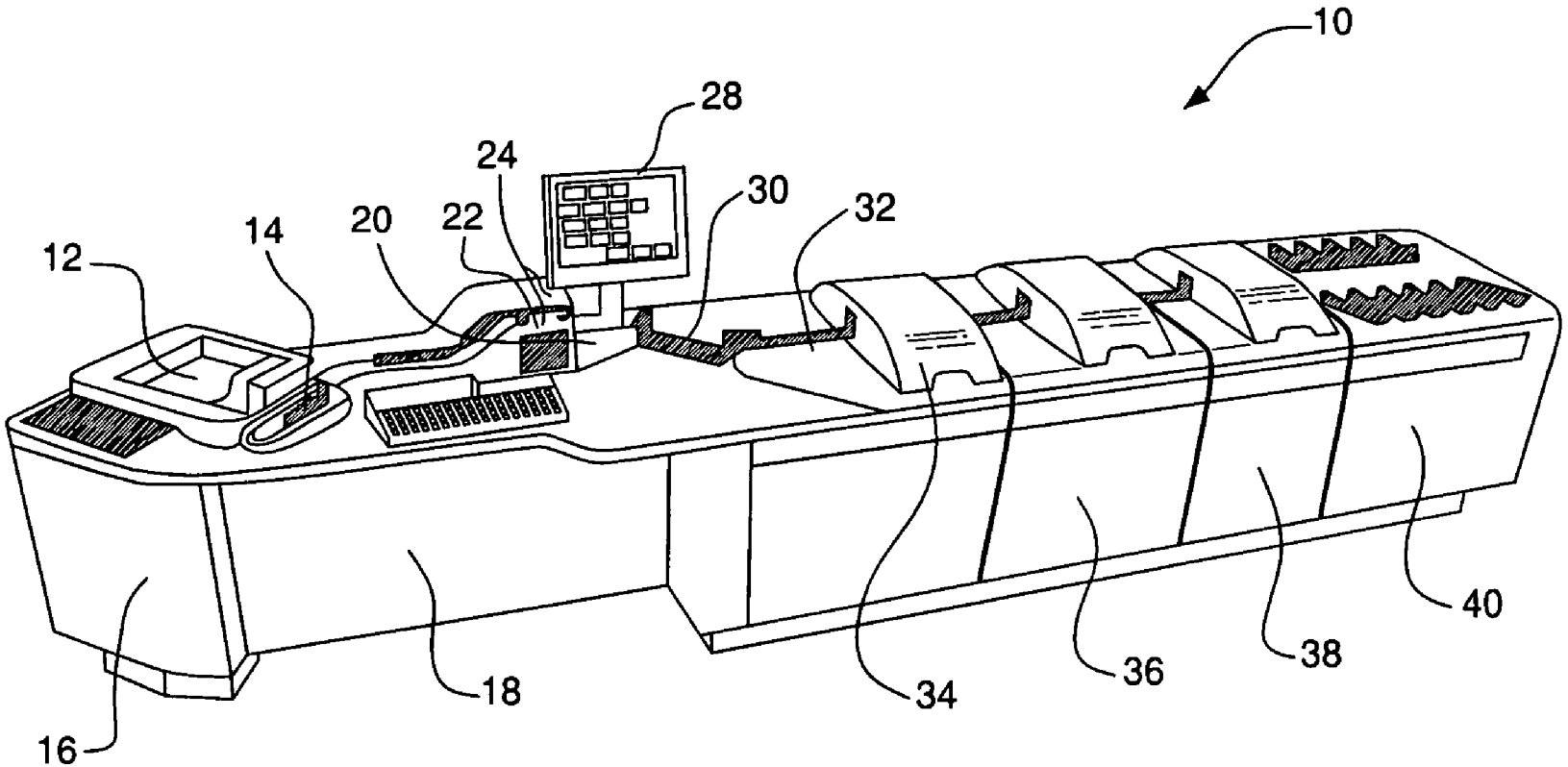
FIG. 1 illustrates a document processing system made in accordance with the invention

FIG. 1 illustrates a document processing system for feeding and transporting documents at 10. System 10 includes a primary feeder 12 and a secondary feeder 14. Cabinet 16 houses a computer running software for system 10. System 10 further includes removable kneewell panel 18. The feeders act to separate and feed documents singly, in order, from a stack. The remainder of the system is the transporting portion of the system, which includes a number of roller pairs and/or belts to convey the documents, one at a time, through a track past other processing devices that perform operations on the documents.

As shown in FIG. 1, a number of processing devices are located in the transporting portion of the system 10. Magnetic ink character recognition (MICR) reader 20 and optical character recognition (OCR) reader 22 are located in the document track following secondary feeder 14. As well, upstream imaging devices 24 image each passing document. The operator display is indicated at 28.

With continuing reference to FIG. 1, system 10 further includes a post-read view station 30, and a low-speed document encoder 32. As well, a multi-jet endorser (MJE) is located at 34. Further down the document track, an amount-only or full-field high-speed encoder 36 and downstream imager 38 process the passing documents. Finally, a 12-pocket stacker module 40 is provided for the actual sorting of the documents into pockets. The drawings illustrate the preferred embodiment, which is depicted as an NDP Quantum Series transport available from Unisys.

In accordance with the invention, system 10 may incorporate a printing mechanism including the improved ribbon spool lock assembly. For example, encoder 32 or encoder 36 could include a printing mechanism including the improved ribbon spool lock assembly.

Figure 2:
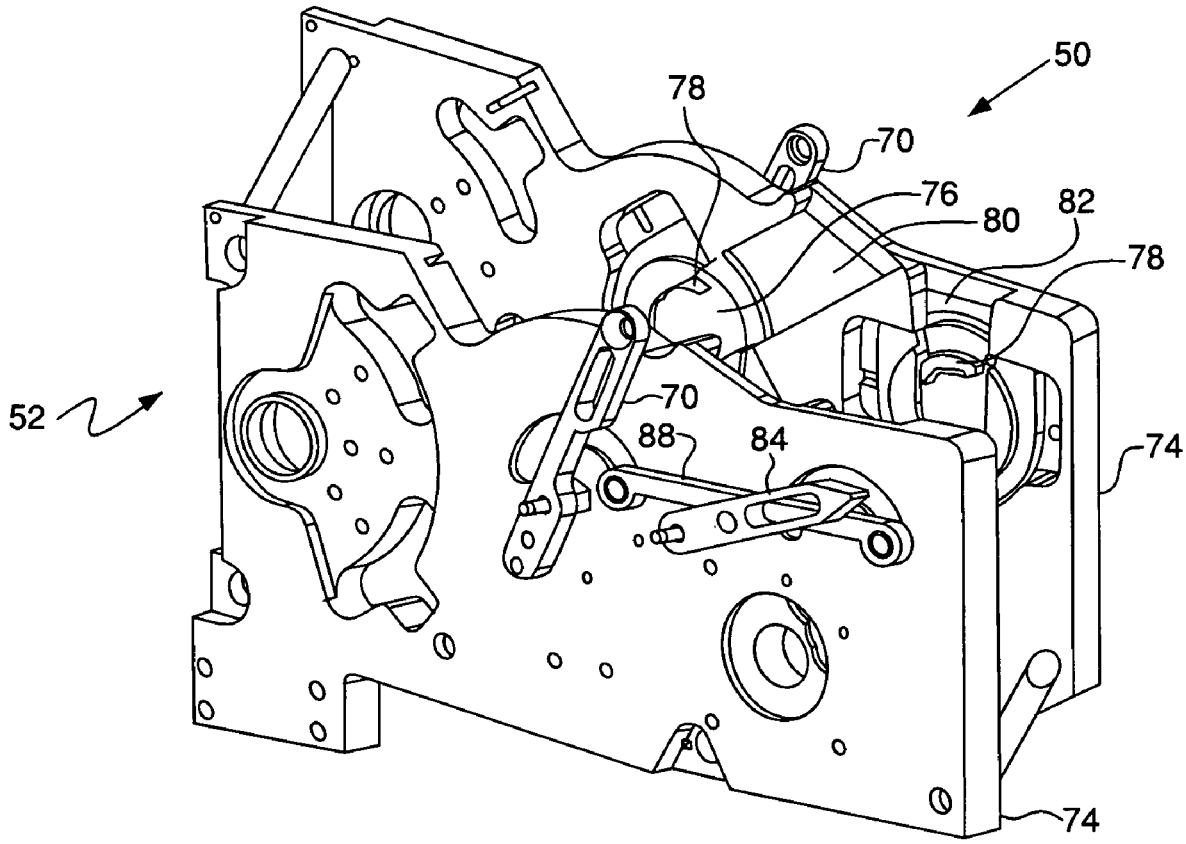
FIG. 2 is a perspective view of a ribbon spool lock assembly in a print mechanism of the document processing system in the preferred embodiment of the invention.
Figure 3D:
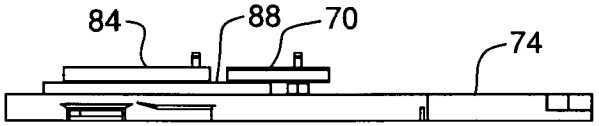
FIG. 3D illustrates the side plate of FIG. 3A, viewed from the top.
Figure 3C:
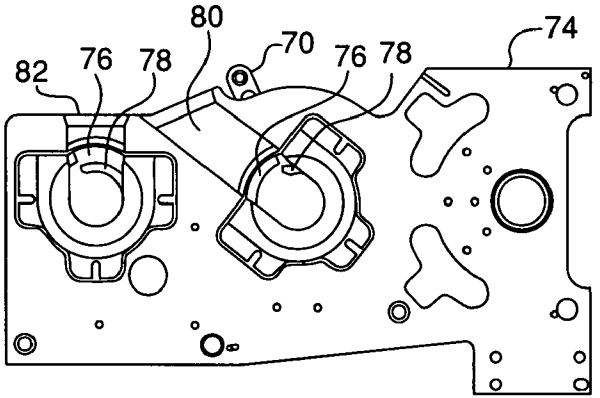
FIG. 3C illustrates the side plate of FIG. 3A, viewed from the inside.
Figure 3B:
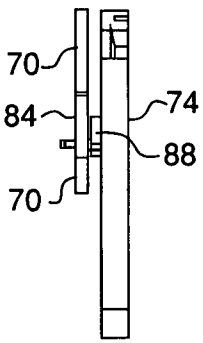
FIG. 3B is an end view of the side plate of FIG. 3A.
Figure 3A:
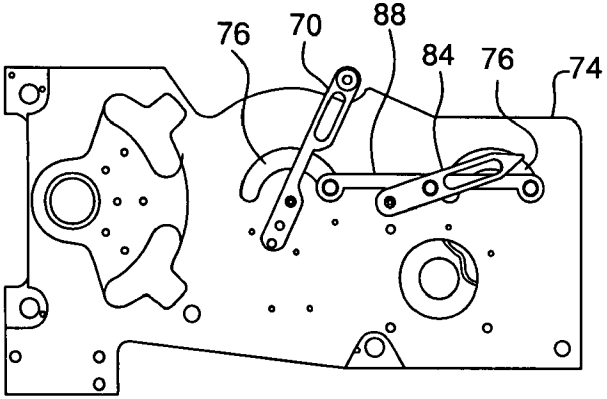
FIG. 3A illustrates one side plate of the printing mechanism, viewed from the outside.

FIGS. 2, 3A–3D, and 4A–4C illustrate a preferred embodiment of the printing mechanism including the preferred implementation of the ribbon spool lock assembly. As best shown in FIG. 2, the printing mechanism is generally indicated at 50. Documents being processed by the system travel down a document path that passes through printing mechanism 50. The printing impact elements (not specifically shown) are mounted to printing mechanism 50 in the area generally indicated at 52.

Printing mechanism 50 is equipped with a pair of ribbon spools, and requires that the ribbon spools be locked in position radially when printing mechanism 50 is functioning. The locking function is provided by a positive radial spool lock which must be opened by some operator interaction when ribbon is to be replaced.

Figure 5:
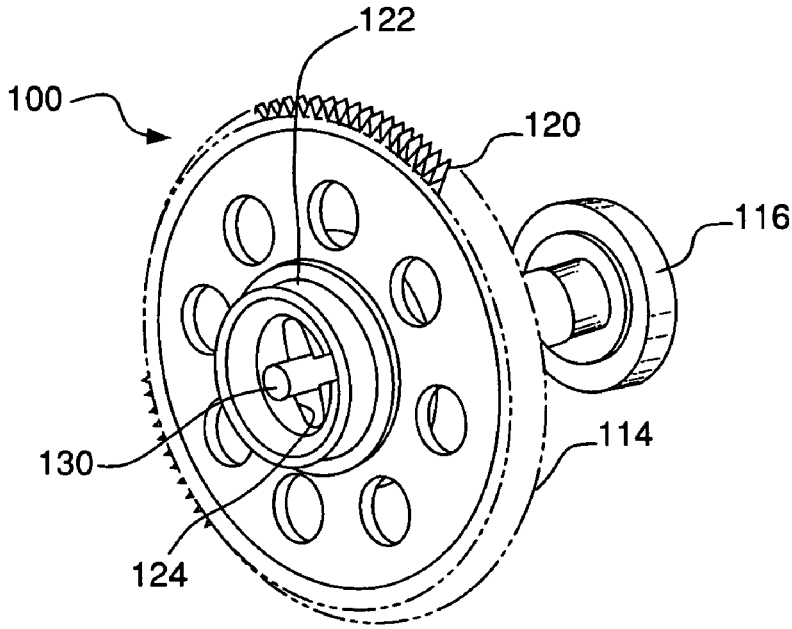
FIGS. 5 and 6 illustrate an exemplary ribbon spool for use in the printing mechanism.
Figure 6:
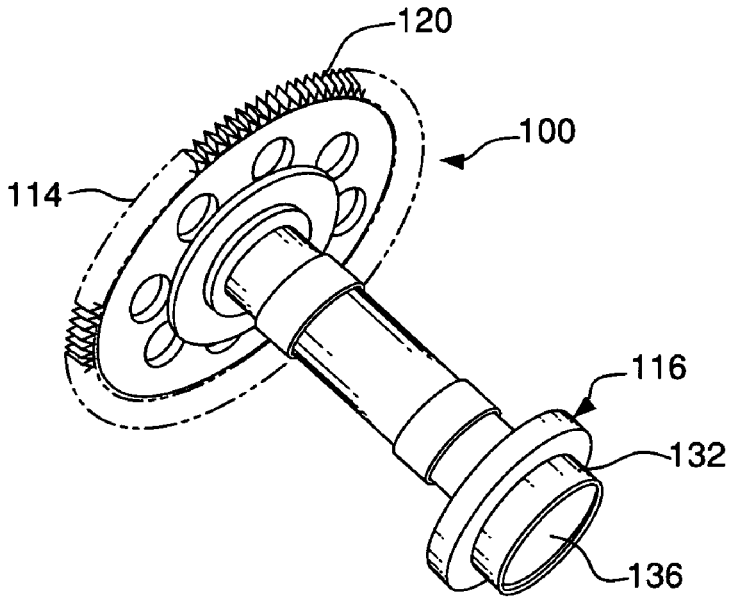

FIGS. 5 and 6 illustrate a preferred, hand-separable ribbon spool shaft assembly which adapts a plain ribbon spool so as to provide drive and location functions. The complete assembly is indicated at 100. The shaft assembly 100 holds a plain ribbon spool. Shaft assembly 100 includes a first, driving, shaft part 114, and a second, cooperating, shaft part 116. The two shaft parts 114, 116 are assembled to the ribbon spool and cooperate to provide a manual hand-action locking mechanism for locking the shaft parts 114, 116 together when assembled to the ribbon spool.

Driving shaft part 114 includes gear drive means 120, and first bearing/locating surface 122. The hand-separable function is provided by a push-and-turn arrangement 136 built into the two-piece shaft assembly 100. As shown, end 130 of cooperating shaft part 116 extends through aperture 124 of driving shaft part 114, and this cooperation provides the locking mechanism for locking the shaft parts together.

Cooperating shaft part 116 includes second bearing/locating surface 132. Spring means enclosed within shaft part 116 provide both the locking force for the push-and-turn function and the necessary lateral force to clamp the two shaft halves onto the ribbon spool to eliminate lateral tolerance variations.

Shaft assembly 100 locates the ribbon spool radially and in all three axes of translation and provides the necessary rotational bearing and locating surfaces to position the ribbon spool correctly in the printing mechanism 50. In the printing mechanism 50, the shaft allows the ribbon spool to rotate to unwind/rewind correctly, and provides gear drive means to drive/retard the rotating ribbon spool.

It is appreciated that shaft assembly 100 is exemplary, and a variety of shaft assemblies could be used in combination with a print mechanism having a ribbon spool lock assembly made in accordance with the invention.

With continuing reference to FIGS. 2, 3A–3D, and 4A–4C, the preferred embodiment of the printing mechanism and ribbon spool lock assembly further includes a pivoting ribbon tension arm 70. Tensioner arm 70 applies tension to the ribbon for printing-related purposes. Tensioner arm 70 must be pivoted out of its normal operating position when ribbon is to be replaced, and held out of position during the replacement process. Yet, tensioner arm 70 must be returned to the normal operating position before normal printing recommences. An appropriate spring mechanism may be used to bias tensioner arm 70 toward the normal operating position.

Printing mechanism 50 includes side plates 74. A pair of linked rotating hubs 76 are built into each side 74 of printing mechanism 50. Locking hubs 76 include locking features 78 that protrude into print mechanism 50 in such a way as to radially lock the ribbon spools in the correct positions for printing. In this way, each end of each installed ribbon spool is radially locked. Slots 80 and 82 are for receiving the ribbon spools.

Locking hubs 76 are pivoted into a released or unlocked position by way of two pivoting lock arms 84. Lock arms 84 may be designed to be operated with the operator's fingers. When in the released position, the linked locking hubs 76 are pivoted out of the exit/entry path (slots 80 and 82) of the ribbon spools. This allows the ribbon spools to be removed and replaced.

In the preferred embodiment, pivoting lock arms 84 include additional features which interlock (interlocking is shown in FIGS. 4A–4D) with the pivoting ribbon tensioner arm 70 to automatically pivot and lock the tensioner arm 70 to its load ribbon position. An appropriate spring mechanism may be used to bias lock arms 84 toward the normal operating position.

Rotating hubs 76, with locking features 78 that protrude into printing mechanism 50, are linked by link 88. As shown, locking hubs 76 are in the normal operating positions in FIGS. 3A–3D, with locking features 78 blocking the exit/entry path (slots 80 and 82) of the ribbon spool.

Figure 4C:
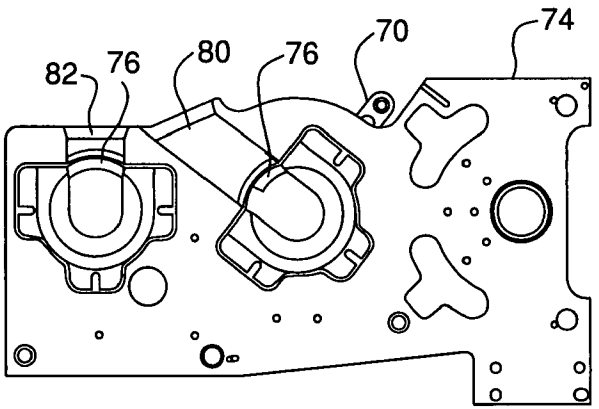
FIGS. 4A–4C illustrate the other side plate of the printing mechanism.
Figure 4B:
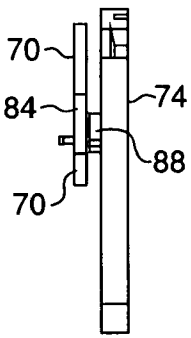
Figure 4A:
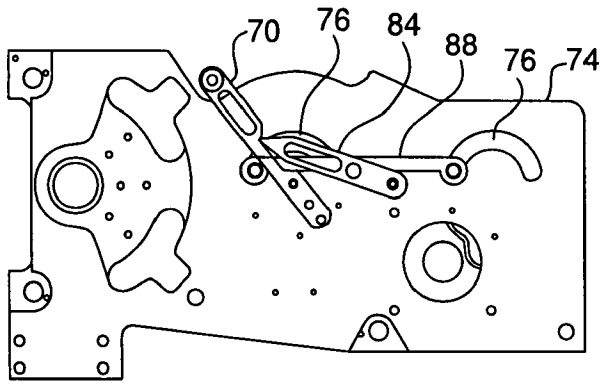

In FIGS. 4A–4C, locking hubs 76 are pivoted into the released or unlocked position, out of the exit/entry path (slots 80 and 82) of the ribbon spools such that locking features 78 no longer radially lock the ribbon spools in the correct positions for printing. As shown, when hubs 76 are unlocked, tensioner arm 70 is in its load ribbon position.

In operation of the preferred embodiment of the invention, an operator cannot remove ribbon spools until locking hubs 76 are rotated to the correct released positions (FIGS. 4A–4C) by means of the two pivoting lock arms 84. This causes tensioner arm 70 to rotate to the correct load ribbon position. Once the operator threads the new ribbon through the printer mechanism 50 and initially tensions the printer system manually or by some other automated ribbon advance feature, the pivoting ribbon tensioner arm 70 is caused to rotate forward and automatically release the two pivoting lock arms 84. At this point, an appropriate spring mechanism (not specifically shown) causes linked locking hubs 76 to rotate back to the correct locked position for printing (FIGS. 2 and 3A–3D).

Although the preferred embodiment is illustrated with features that lock each side of each ribbon spool (supply and takeup) by utilizing a pair of linked locking hubs on each side of printing mechanism 50, together with two pivoting lock arms 84, other implementations are possible. Appropriate locking hubs could be used to secure only one spool of ribbon. As well, it is possible that the entire system may be operated automatically rather than by manual operation, in which case the interlocking of various parts in their correct positions would be by sensors and electronic control rather than by physical, mechanical interlocks.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In combination with a printing mechanism of the type in which ribbon spools are required to be locked in place radially when the printing mechanism is functioning, wherein the printing mechanism includes a pivoting ribbon tension arm that applies tension to the ribbon for printing-related purposes and the tension arm must be pivoted out of its normal operating position when ribbon is to be replaced and held out of position during the replacement process, the improvement comprising:

a ribbon spool lock assembly including a rotating locking hub on the side of the printing mechanism, the rotating locking hub including a locking feature that protrudes into the printing mechanism to radially lock the ribbon spool when the locking hub is in a locked position thereby providing a positive radial spool lock, the assembly further including a pivoting lock arm for pivoting the locking hub into an unlocked position in which the locking feature is disengaged from the ribbon spool.

2. The combination of claim 1 wherein the pivoting lock arm and the tension arm are arranged with respect to each other such that the pivoting lock arm interlocks with the tension arm to lock the tension arm in its ribbon load position when the lock arm is pivoted to the unlocked position.

3. The combination of claim 1 wherein the ribbon spool lock assembly further comprises:

a second rotating locking hub on the other side of the printing mechanism, the second rotating locking hub including a locking feature that protrudes into the printing mechanism to radially lock the ribbon spool from the other side when the second locking hub is in a locked position thereby providing a positive radial spool lock, the assembly further including a second pivoting lock arm for pivoting the second locking hub into an unlocked position in which the locking feature is disengaged from the ribbon spool.

4. The combination of claim 3 wherein the second pivoting lock arm and the tension arm are arranged with respect to each other such that the second pivoting lock arm interlocks with the tension arm to lock the tension arm in its ribbon load position when the second lock arm is pivoted to the unlocked position.

5. In combination with a printing mechanism of the type in which ribbon spools are required to be locked in place radially when the printing mechanism is functioning, wherein the printing mechanism includes a pivoting ribbon tension arm that applies tension to the ribbon for printing-related purposes and the tension arm must be pivoted out of its normal operating position when ribbon is to be replaced and held out of position during the replacement process, the improvement comprising:

a ribbon spool lock assembly including a pair of rotating locking hubs on the side of the printing mechanism, each rotating locking hub including a locking feature that protrudes into the printing mechanism, the locking features radially locking a pair of ribbon spools when the pair of locking hubs are in locked positions thereby providing positive radial spool locks, the assembly further including a pivoting lock arm for pivoting the pair of locking hubs into unlocked positions in which the locking features are disengaged from the pair of ribbon spools.

6. The combination of claim 5 wherein the pivoting lock arm and the tension arm are arranged with respect to each other such that the pivoting lock arm interlocks with the tension arm to lock the tension arm in its ribbon load position when the lock arm is pivoted to the unlocked position.

7. The combination of claim 5 wherein the ribbon spool lock assembly further comprises:

a second pair of rotating locking hubs on the other side of the printing mechanism, the second pair of rotating locking hub including locking features that protrude into the printing mechanism to radially lock the ribbon spools from the other side when the second pair of locking hubs are in locked positions thereby providing positive radial spool locks, the assembly further including a second pivoting lock arm for pivoting the second pair of locking hubs into unlocked positions in which the locking features are disengaged from the pair of ribbon spools.

8. The combination of claim 7 wherein the second pivoting lock arm and the tension arm are arranged with respect to each other such that the second pivoting lock arm interlocks with the tension arm to lock the tension arm in its ribbon load position when the second lock arm is pivoted to the unlocked position.

9. An apparatus comprising:

a document processing system including a feeder stage and a transport stage;

the feeder stage including a feeder wherein the feeder acts to feed documents;

the transport stage being downstream of the feeder stage for receiving the fed documents;

the document processing system including a printing mechanism of the type in which ribbon spools are required to be locked in place radially when the printing mechanism is functioning, wherein the printing mechanism includes a pivoting ribbon tension arm that applies tension to the ribbon for printing-related purposes and the tension arm must be pivoted out of its normal operating position when ribbon is to be replaced and held out of position during the replacement process;

a ribbon spool lock assembly including a rotating locking hub on the side of the printing mechanism, the rotating locking hub including a locking feature that protrudes into the printing mechanism to radially lock the ribbon spool when the locking hub is in a locked position thereby providing a positive radial spool lock; and the assembly further including a pivoting lock arm for pivoting the locking hub into an unlocked position in which the locking feature is disengaged from the ribbon spool.

10. The apparatus of claim 9 wherein the pivoting lock arm and the tension arm are arranged with respect to each other such that the pivoting lock arm interlocks with the tension arm to lock the tension arm in its ribbon load position when the lock arm is pivoted to the unlocked position.

11. The apparatus of claim 9 wherein the ribbon spool lock assembly further comprises:

a second rotating locking hub on the other side of the printing mechanism, the second rotating locking hub including a locking feature that protrudes into the printing mechanism to radially lock the ribbon spool from the other side when the second locking hub is in a locked position thereby providing a positive radial spool lock, the assembly further including a second pivoting lock arm for pivoting the second locking hub into an unlocked position in which the locking feature is disengaged from the ribbon spool.

12. The apparatus of claim 11 wherein the second pivoting lock arm and the tension arm are arranged with respect to each other such that the second pivoting lock arm interlocks with the tension arm to lock the tension arm in its ribbon load position when the second lock arm is pivoted to the unlocked position.

13. The apparatus of claim 9 wherein:

the ribbon spool lock assembly includes a pair of rotating locking hubs on the side of the printing mechanism, each rotating locking hub including a locking feature that protrudes into the printing mechanism, the locking features radially locking a pair of ribbon spools when the pair of locking hubs are in locked positions thereby providing positive radial spool locks, the pivoting lock arm being arranged to pivot the pair of locking hubs into unlocked positions in which the locking features are disengaged from the pair of ribbon spools.

14. The apparatus of claim 13 wherein the pivoting lock arm and the tension arm are arranged with respect to each other such that the pivoting lock arm interlocks with the tension arm to lock the tension arm in its ribbon load position when the lock arm is pivoted to the unlocked position.

15. The apparatus of claim 13 wherein the ribbon spool lock assembly further comprises:

a second pair of rotating locking hubs on the other side of the printing mechanism, the second pair of rotating locking hub including locking features that protrude into the printing mechanism to radially lock the ribbon spools from the other side when the second pair of locking hubs are in locked positions thereby providing positive radial spool locks, the assembly further including a second pivoting lock arm for pivoting the second pair of locking hubs into unlocked positions in which the locking features are disengaged from the pair of ribbon spools.

16. The apparatus of claim 15 wherein the second pivoting lock arm and the tension arm are arranged with respect to each other such that the second pivoting lock arm interlocks with the tension arm to lock the tension arm in its ribbon load position when the second lock arm is pivoted to the unlocked position.

* * * * *